United States Patent [19]

Möller

[11] 4,024,792

[45] May 24, 1977

[54] AUTOMATIC SHOULDER ARM

[75] Inventor: Tilo Möller, Oberndorf, Germany

[73] Assignee: Heckler & Koch GmbH, Oberndorf, Germany

[22] Filed: May 23, 1974

[21] Appl. No.: 472,868

[30] Foreign Application Priority Data

May 24, 1973 Germany ..... 2326525

[52] U.S. Cl. ..... 89/129 B; 42/17; 42/71 R; 89/1 K; 89/33 B; 89/159; 89/162; 89/164

[51] Int. Cl.[2] ..... F41D 11/24

[58] Field of Search ..... 89/37 GM, 42 B, 159

[56] References Cited

UNITED STATES PATENTS

| | | | |
|---|---|---|---|
| 2,093,169 | 9/1937 | Holek | 89/159 |
| 2,146,185 | 2/1939 | Holek | 89/42 B |
| 3,410,175 | 11/1968 | Johnson et al. | 89/159 |

*Primary Examiner*—Stephen C. Bentley
*Attorney, Agent, or Firm*—Spencer & Kaye

[57] ABSTRACT

In an automatic shoulder arm designed as a gas operated weapon, especially an automatic rifle, the entire, fully operable weapon system, comprising the barrel, the bolt system, the gas operated action, the recoil spring arrangement, the cartridge feeding mechanism and a portion of the trigger mechanism, is slidably mounted in a receiver designed as a stock. During automatic fire, the weapon system is not returned to its initial position after every shot, but performs a recoil movement during a plurality of shots before it reaches a rear end position, which it maintains until the automatic fire is interrupted. The recoil movement can be utilized for controlling bursts of varying duration and cadence.

25 Claims, 7 Drawing Figures

AUTOMATIC SHOULDER ARM

The present invention relates to an automatic shoulder arm, especially an automatic rifle, having a barrel which is movably mounted in its longitudinal direction and which performs a rearward movement together with the locked bolt system, loaded by a recoil spring, against the force of a counterrecoil spring after a shot is fired.

In the field of firearms, it is generally known to mount the barrel movably in its longitudinal direction in order to permit it to travel rearward together with the bolt system after a shot has been fired in order to absorb the recoil. This rearward movement is generally performed against the force of springs and brake systems which stop the rearward travel and return the barrel to its initial position again. Moreover, in the field of automatic firearms it is also known to utilize the rearward travel in order to bring the rigidly locked bolt system into engagement with control cams which impart a movement to the bolt system which causes it to unlock. An example of an automatic shoulder arm of this type is the known MG 34 machine gun.

Although, in the automatic shoulder arms of this type, the purpose of the rearward travel of the barrel and the bolt system is to reduce the recoil of the weapon and thus simplify handling of the weapon, the weapon nevertheless suffers from significant vibration when firing bursts or automatic fire; these vibrations are caused by the fact that the barrel is returned to its initial position after every shot, thereby continuously performing, in the same manner as the bolt system, reciprocating movements in the longitudinal direction of the receiver, which must be absorbed at each end of the reciprocating movement. It is therefore very difficult to fire accurate bursts with firearms of this type if they are not properly supported.

On the other hand, it is the object of the present invention to design an automatic shoulder arm in such a manner that the inaccuracy caused by the recoil of the weapon is reduced and at least short bursts can be fired with, for all practical purposes, no recoil.

According to the present invention, this object is solved in that the shoulder arm is designed as a gas operated weapon and the entire, fully operational weapon system, comprising the barrel, the bolt system, the gas operated action, the recoil spring arrangement, the cartridge feeding mechanism and a portion of the trigger mechanism, is slidably mounted in a receiver designed as a stock.

Thus, in the shoulder arm according to the invention not only the barrel and the bolt system perform a rearward movement in the locked condition, but a fully operational weapon system, which does not need to return to its initial position in order to permit an additional shot to be fired, but which can perform an almost continuous rearward movement while a plurality of successive shots are being fired before it is braked at the end of the available path of travel. During this rearward movement, for all practical purposes no forces whatsoever are transmitted to the receiver, designed as a stock, which could deflect the weapon from the target, thereby ensuring extremely high accuracy during this return movement. By means of suitable burst control means, it is then possible to ensure that bursts are limited to that number of shots which are required for bringing the weapon system from its forwardmost position to its rearmost position. This then ensures that there is only a noticeable recoil on the receiver when the last round has left the barrel, so that bursts which are, for all practical purposes, recoil-free can be fired with extremely high accuracy.

In a preferred embodiment of the invention, the gas operated action comprises two gas cylinders arranged parallel to the barrel, the front ends of the gas cylinders being connected with the barrel by means of a block containing radial channels through which the bore of the barrel communicates with their interiors and the rear ends thereof being connected with the barrel by means of a cross member. A trigger housing for mounting components of the trigger mechanism is arranged directly behind the cross member and travels with it. The cross member and the block have lateral shoulders and the rear end of the trigger assembly housing has lateral arms which engage the guide rails attached in the receiver. This provides very simple, dependable mounting of the weapon system without requiring an especially high degree of sophistication herefor. In a further development of the invention, the front end of the bolt system can have a tubular section with which the bolt system is located on the rear end of the barrel, extending from the cross member, and the rear end of the bolt system engages the rails with lateral webs. Locating the bolt system on the barrel and in the guide rails also ensures very simple location and guidance of the bolt system here, also, which does not require maintenance of very close tolerances in spite of the rearwardly moving weapon system, as the front end of the bolt system is located directly on the barrel, thereby ensuring proper alignment of barrel and bolt system at all times.

In addition, the design of the weapon system with gas cylinders arranged parallel to the barrel also offers the possibility of arranging first coil compression springs on the gas cylinders which act as counterrecoil springs and are in a supporting relationship with the block connecting the gas cylinders and the barrel, on the one hand, and with an abutment attached in the receiver, on the other. In this manner, no additional mounting means are required for the counterrecoil springs, and, in particular, no extra space is required by them, which is of considerable significance for a shoulder arm, as its dimensions are of necessity limited.

In addition, the shoulder arm according to the invention can also have a buffer arrangement between the weapon system and the receiver for stopping the weapon system, travelling rearwardly during a plurality of successive shots, in a rear end position. A buffer arrangement of this type permits not only short bursts to be fired with the shoulder arm according to the invention, but also sustained automatic fire, in which the weapon system remains in its rear position. If the shoulder arm has gas cylinders arranged parallel to the barrel in the above described manner, the buffer arrangement can also comprise second coil compression springs arranged on the gas cylinders, the second coil compression springs surrounding the first coil compression springs concentrically and being coiled in the opposite sense, having a higher spring rate than the first coil compression springs, and having their length selected in such a manner that, at the end of the intended return travel path, if necessary with the first coil compression springs being interposed, they are in a supporting relationship with tube sections on the block surrounding at least a portion of their length and with the abutment.

In a further development of the invention, in its position of rest the weapon system can be in a contacting relationship with a counterrecoil buffer attached in the receiver, the counterrecoil buffer permitting a limited forward movement of the weapon system. A counterrecoil buffer of this type serves to absorb impacts which could result through a tendency of the weapon system to move in a forward direction when the first shot is fired, and further forms an elastic abutment for retaining the weapon system in its position of rest. The counterrecoil buffer can be formed, in a simple manner, of bolts which are slidably mounted in an abutment attached in the receiver and whose heads, under the force of the coil compression springs surrounding them, are in a contacting relationship, in the position of rest of the weapon system, with the front side of the cross member connecting the gas cylinders and the barrel.

The above mentioned abutments can be formed in a simple manner by a receiver flange connecting the guide rails in the vicinity of their centers, said receiver flange having through holes for the barrel and the gas cylinders and being located directly adjacent to the cross member connecting the gas cylinders and the barrel in the position of rest of the weapon system.

In a further development of the invention, the gas operated action can comprise a sleeve-shaped slide surrounding the rear end of the barrel and the front end of the bolt system, said slide being connected with pistons arranged in the gas cylinders by means of rods, being in engagement with the bolt system by means of locking members and causing the bolt system to travel forward and lock. In this arrangement, the recoil springs can then be arranged concentrically to the rods inside the gas cylinders and can be in a supporting relationship with the base of the gas cylinders on the one hand and with the pistons on the other. In this manner, no extra space is required for the recoil springs either and, in particular, the recoil springs are not arranged behind the bolt system, requiring valuable space which can now be utilized completely for the rearward travel of the weapon system. In addition, with this arrangement there are no difficulties whatsoever in finding abutments for the recoil springs, which must travel rearwardly with the weapon system.

In a preferred embodiment of the invention, the problem of ensuring feeding of the cartridges in the recoiling weapon system is solved in that the cartridge feeding mechanism comprises a magazine arranged parallel to the barrel and a claw arrangement articulated to the bolt system, the claw arrangement removing the cartridges, standing generally perpendicular to the barrel, from the magazine and inserting them in the space between the open bolt system and the rear end of the barrel. This arrangement provides the particular advantage that the magazine, arranged parallel to the barrel, does not protrude beyond the weapon laterally, but can be located in the receiver which serves to mount the weapon system, so that there are no recoiling components projecting beyond the receiver which could represent a hazard in the use of the shoulder arm according to the invention. At the same time, because of the length of the barrel there is a space of significant size available next to the barrel, in which a large number of cartridges can be located, so that magazines having an especially large capacity can be employed.

And finally, the claw arrangement for feeding the cartridges ensures that the cartridges are inserted in a positive manner, without being subjected to high impact, so that the most frequent previous causes of jamming and failures are avoided with an arrangement of this type and, because of the minimum strain to which the cartridges are subjected, caseless cartridges can also be fed with a mechanism of this type.

While all previously treated members of the shoulder arm according to the invention belong to the recoiling weapon system, the trigger of the weapon should be mounted in the receiver so that its position is not altered during firing and should be coupled, by means of suitable intermediate members, with those components of the trigger mechanism which belong to the recoiling weapon system. In a preferred embodiment of the invention, the trigger mechanism comprises a trigger and a rail, mounted in the receiver, extending parallel to the path of the weapon system, whose rear end is pivotally mounted about an axle in the receiver arranged at right angles to the path of the weapon system and whose front end is in engagement with the trigger in such a manner that, when the trigger is pulled, the distance between the rail and the weapon system is reduced. That portion of the trigger mechanism belonging to the weapon system comprises members controlled by the distance between the rail and the weapon system, the members causing shots to be fired if a given distance is not maintained. The employment of a rail of this type thus permits shots to be fired independently of the position of the weapon system, so that sustained automatic fire can be initiated during the rearward travel of the weapon system if the distance between the rail and the weapon system is reduced sufficiently by pulling the trigger. The automatic fire will continue as long as the trigger remains pulled, even if the weapon system reaches a rear end position and remains generally in this end position.

However, in a simple manner, the rearward travel of the weapon system can also be employed for controlling modes of fire which include bursts with a limited number of shots. For this purpose, in a further development of the invention it is sufficient if the rail has a recess through which the distance between the rail and the weapon system is increased by such an amount at the location of the recess that the members controlled by the distance between the rail and the weapon system cause the sequence of shots to be interrupted when they respond to this recess after a predetermined number of shots as a result of the rearward travel of the weapon system. For example, the shoulder arm according to the invention can be designed in such a manner that the weapon system has covered the recoil path available to it after three shots and the recess is at that point which the member responding to the distance between rail and weapon system has reached after the third shot, so that with this development of the shoulder arm according to the invention bursts of three shots each are fired during which there is, for all practical purposes, no recoil whatsoever, permitting these bursts to be fired extremely accurately.

However in order to permit sustained automatic fire or bursts consisting of a greater number of shots to be fired in spite of a recess of this type, the recess in the rail can be filled or bridged by means of a switch member.

To set additional modes of fire, a lever can be in an operative connection with the trigger, the lever being able to be brought into engagement, by swivelling the trigger, with the members, causing shots to be fired, of the weapon system located in its position of rest in order to fire a shot before the rail has been deflected sufficiently to fire shots. With the aid of an adjustable stop, the travel of the trigger can be limited in such a manner as to prevent the rail from swivelling enough to fire shots.

This lever can be a transmission lever pivotally mounted about the trigger, for which there is an adjustable guide which eithr guides the transmission lever past the members causing shots to be fired at a distance therefrom or brings the transmission lever into engagement with these members when the trigger is pulled. If the guide for the transmission lever is set in such a manner that, when the trigger is pulled, the transmission lever comes into engagement with the members causing shots to be fired, a shot will be fired when the trigger is pulled. If the bar is not lifted sufficiently by the trigger, the rearward travel of the weapon system will interrupt the engagement between the transmission lever and the weapon system, thereby immediately interrupting the sequence of shots. However the members causing shots to be fired come into engagement with the transmission lever again when the weapon system returns to its position of rest, so that an additional shot is then fired. In this manner, slow automatic fire is thus possible, whose cadence is determined by the path and velocity of the weapon system during every shot. If the rail is also lifted when the trigger is pulled, this will initiate a burst, as described above, whose duration is determined by the arrangement of a recess in the rail. However while this sequence of shots can no longer be initiated after being interrupted by means of the rail, it is initiated anew each time with the aid of the transmission lever when the weapon system returns to its initial position after a burst. Thus, in this manner it is possible to fire a cadence of bursts of limited duration. In addition to, or in place of, the transmission lever, a sear can also be mounted in the receiver which, in its position of rest, is in a contacting relationship with one of the members of the weapon system causing shots to be fired in the position of rest of the weapon system and which can be swivelled in such a manner by means of a catch attached to the trigger when the trigger is pulled that it causes a shot to be fired, while the catch slides off the sear, thus releasing the sear and permitting it to return to its position of rest. In conjunction with the catch acting as an interrupter, this sear permits single shots to be fired. This sear then becomes effective when the travel of the trigger is limited in such a manner that the bar is not sufficiently lifted and the transmission lever, if present, is guided past the members causing shots to be fired at a distance therefrom by means of the adjustable guide.

All in all, the above described details of a preferred trigger system for the shoulder arm according to the invention permit, through the utilization of the rearward travel of the weapon system, the following modes of fire: Single fire, individual bursts of limited duration, slow automatic fire controlled by the movement of the weapon system, a cadence of bursts of limited duration controlled by the movement of the weapon system, and finally sustained automatic fire with the same cadence as the bursts.

The above discussed and other objects, features, advantages and embodiments of the present invention will become more apparent from the following description thereof, when taken in connection with the practical example shown in the accompanying drawings. The features contained in the description and drawings may be employed in other embodiments individually or in any desired combination. In the drawings, FIG. 1 shows a longitudinal section through an automatic rifle according to the invention;

FIGS. 8 and 9 are longitudinal sectional views of the bolt system in closed and open positions, respectively.

Figure 1:
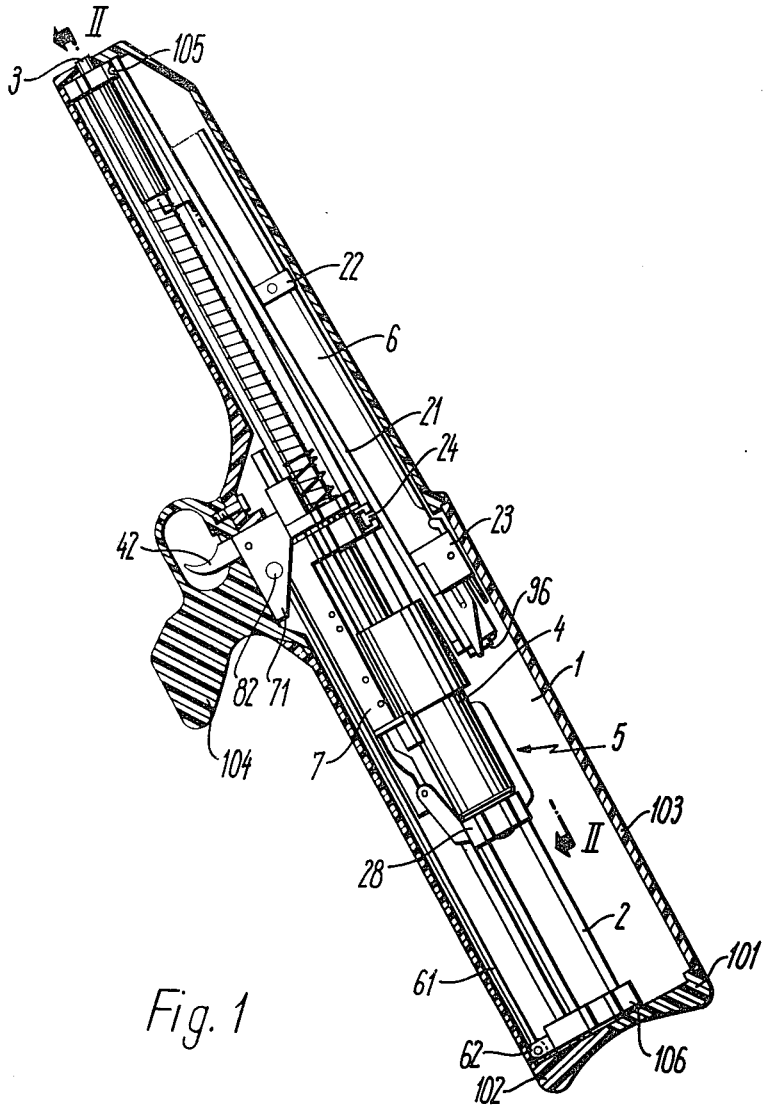

Referring now to the drawings, wherein like reference numerals designate like parts throughout the several views, FIG. 1 shows as a practical example a schematically illustrated automatic rifle having a weapon system guided in rails 2 in a receiver 1, said weapon system comprising the barrel 3, a bolt system 4, located directly adjacent to the rear end of the barrel, with a claw arrangement 5 for feeding the cartridges, a magazine 6, arranged above barrel 3, and a housing 7 with a portion of the trigger mechanism.

Figure 2:
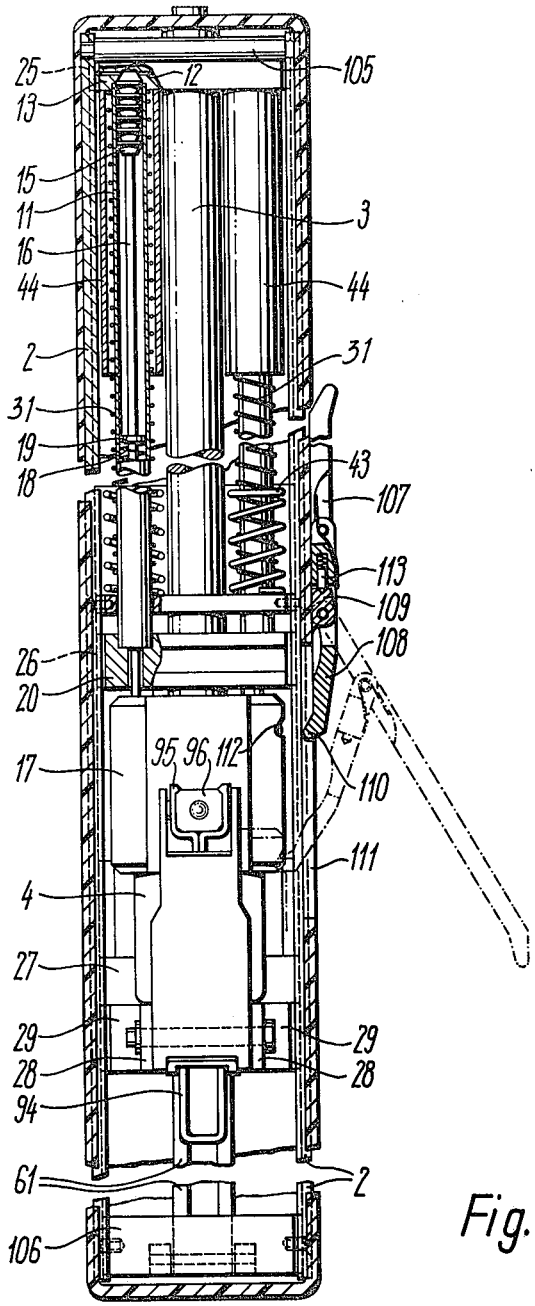
FIG. 2 shows the weapon system of the rifle according to FIG. 1, partially as a top view and partially as a section along line II — II, with a larger scale.

The illustrated rifle has a gas operated action. As seen in FIG. 2, the gas operated feeding mechanism consists of two gas cylinders 11, which are arranged parallel to barrel 3 and whose front ends communicate with the bore 14 of the barrel through radial channels 12 located in a block 13 placed on the front end of the barrel. Arranged within gas cylinders 11 are pistons 15 which are connected with a sleeve 17, serving to lock bolt system 4, by means of piston rods 16, extending out of the rear ends of gas cylinders 11. Inside gas cylinders 11, piston rods 16 are surrounded by recoil springs designed as coil compression springs, said recoil springs being in a supporting relationship with a shoulder 19 arranged on piston rods 16, on the one hand, and with a cross member 20, into which the rear ends of gas cylinders 11 are inserted to seal them to the rear, on the other hand. Said cross member 20 is also connected with barrel 3, so that barrel 3, gas cylinders 11, block 13 and cross member 20 form a very stable frame-like assembly. As can be seen from FIG. 3 in particular, housing 7, containing those components of the trigger mechanism which belong to the movable weapon system, is attached to cross member 20. Magazine 6 is located in a seat formed by guide plate 21 with retaining clips 22 and 23; its front end is pivotally mounted on block 13; and it is guided near its rear end by means of a leg 24 in a lateral slot in cross member 20. The tubular front end of bolt system 4 guides it on the rear end of barrel 3, which has locking surfaces, which are not illustrated in more detail, with which locking members arranged in the tubular end of the bolt system come into engagement, whereby cam surfaces arranged in the interior of sleeve 17 operate conointly with said locking members. When the rifle is ired, the bolt system is brought from its open position, hown in FIGS. 1 to 3, to its closed position by means of recoil springs 18 arranged in gas cylinders 11, which ress sleeve 17 forward by acting on shoulders 19 and iston rods 16, whereby sleeve 17, in turn, moves bolt ystem 4 into the closed position by means of its cam urfaces and the locking members. When bolt system 4 as reached the closed position, the cam surfaces on leeve 17 press the locking members behind locking urfaces on the rear end of barrel 3, thereby providing igid locking. After a shot has been fired and the bullet as passed radial channels 12, thereby releasing the gas ressure which is developed behind the bullet, the powler gases act on pistons 15 and push them backward, ausing them to impart a rearward motion to sleeve 17 y means of piston rods 16. This releases the locking nembers, permitting the bolt system to also move rearvardly until it is caught in its rearmost position by the rigger system. This tensions the recoil springs again.

As already mentioned, the previously described veapon system is movably mounted in rails 2 in reeiver 1 in the longitudinal direction of the receiver, ermitting it to move rearwardly under the influence of he recoil forces occurring during firing. For this purose, block 13 and cross member 20 have lateral shoulers 25 and 26 which engage corresponding longitudiial grooves in rails 2. In addition, the rear end of housig 7, which contains those portions of the trigger echanism belonging to the weapon system, has a slide 7, formed of a sheet-metal section, whose ends also ngage longitudinal grooves in rails 2. And finally, the ear end of bolt system 4 has guide members 28 which ngage the same grooves in rails 2 with laterally proecting webs 29 as the lateral shoulders on the block nd on the cross member. In this manner, proper guidnce of both the entire weapon system and the bolt ystem is ensured.

For guiding the bolt system, it is especially important or only the rear end of the bolt system to be guided in e rails and for the front end to be guided directly on e barrel, thereby eliminating the danger of canting as result of unaligned bearings. This ensures proper nctioning of the weapon system in every position in e longitudinal direction of receiver 1.

The weapon system, which moves rearward when a ot is fired, is returned to its initial position by means f first coil compression springs 31 which are arranged n gas cylinders 11 and which are in a supporting relaonship with block 13, connecting the gas cylinders ith barrel 3, on the one hand, and with a spring seat, rmed by a receiver flange 32 located in the area of e center of rails 2, which is mounted in the receiver, n the other hand. As long as the weapon system is cated in its position of rest, receiver flange 32 is arnged directly in front of cross member 20, which onnects the rear ends of the gas cylinders with barrel . The receiver flange accordingly has through holes r barrel 3 and gas cylinders 11. Moreover, counterrecoil buffers are arranged on receiver flange 32; these ounterrecoil buffers are formed of bolts 33 extending rough receiver flange 32 parallel to rails 2 and having eads 34 at their ends facing cross member 20, while ring rings 35 serving as stops are placed on their ther ends, which also protrude from receiver flange 2. Arranged concentrically to bolts 33 are coil comression springs 36, which are in a supporting relationip with heads 34 of bolts 33, on the one hand, and with shoulders in the holes 37 in receiver flange 32 serving to mount bolts 33, on the other hand.

In its position of rest, the weapon system is in a contacting relationship with heads 34 of bolts 33 by means of cross member 20 and is retained in this position by means of a catch 39 mounted in a slot 38 of receiver flange 32, with a nose 40 of catch 39 engaging behind a shoulder on cross member 20. Catch 39 is connected with the trigger 42, mounted in receiver 1, by means of a draw bar 41, so that it is deflected when the trigger is pulled, thereby releasing the cross member of the weapon system before the first shot is fired.

The above mentioned coil compression springs, which serve to return the recoiled weapon system, are not intended to return the weapon system to its initial position after every shot. On the contrary, it is precisely the purpose of the weapon system to also permit firing during the rearward travel of the weapon system in order to allow a plurality of shots to be fired without recoil for all practical purposes. However since the length of rearward travel is necessarily limited, after a certain number of shots the weapon system will reach a position at which the limited length of the receiver and the guide rail no longer permit any additional rearward travel. In order to enable the rifle to keep firing without the kick caused by the recoil becoming too hard, the weapon system is retained in this rearward position by an additional buffer arrangement. Said buffer arrangement comprises second coil compression springs 43 arranged on gas cylinders 11, said coil compression springs 43 concentrically surrounding coil compression springs 31, serving as recoil springs. Said second coil compression springs 43 have a much higher spring rate than the first coil compression springs and are coiled in a sense which is opposite to that of the first coil compression springs in order to permit the two springs to be able to slide one on the other without disturbing each other. Also attached to block 13, connecting the front ends of the gas cylinders and the barrel, are tube sections 44, which concentrically surround the first coil compression springs 31 and whose ends extending in the direction of the rear cross member 20 come into a contacting relationship with the second coil compression springs 43, which are then in a supporting relationship with cross member 20 when the weapon system has reached its rearmost position.

Figure 3:
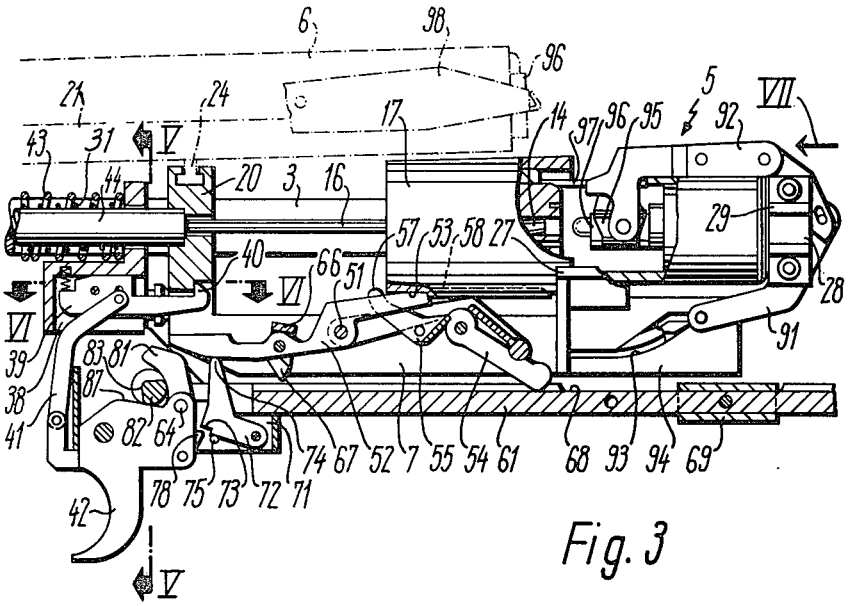
FIG. 3 shows the trigger and bolt systems of the rifle according to FIG. 1, partially as a side view and partially as a section, with an even larger scale.

In order to permit the weapon's trigger to be able to be pulled in every position of the weapon system without having to have trigger 42 follow the movement of the weapon system, the trigger mechanism of the rifle illustrated as a practical example is divided and comprises components mounted in both receiver 1 and housing 7 of the weapon system. Pivotally mounted on a bolt 51 in housing 7, attached to cross member 20 of the weapon system, is a catch link 52, which extends generally parallel to the path of the bolt system and which is spring-loaded counterclockwise, so that the rear end of catch link 52 attempts to engage a recess in sleeve 17 when sleeve 17 is placed in a rearward position by the powder gases acting upon pistons 15 or by a cocking mechanism to be described below. Also mounted in housing 7 are the hammer 54, tensioned by a spring not illustrated in more detail, a release lever 55 retaining hammer 54 in the cocked position, and a hammer cocker 56. In FIG. 3, the above mentioned parts are indicated in the position which they assume in a cocked weapon which is ready to fire. If catch link 52 is swivelled clockwise in a manner which will be described below, sleeve 17 of the bolt arrangement is released and moved forward by recoil springs 18, acting on piston rod 16. During this sequence, sleeve 17 slides past an end 57 of release lever 55, which engages a groove 58 on the bottom of slide 17 during the forward motion of slide 17. When, however, slide 17 reaches its closed position, that portion 59 of sleeve 17 limiting the rear of groove 58 strikes end 57 of release lever 55, causing the release lever to be swivelled counterclockwise, thereby releasing hammer 54. As a result, the hammer can strike a firing pin, arranged in bolt system 4 at right angles to its direction of movement and not described in more detail, and fire a shot. The shot being fired causes first sleeve 17 and then bolt system 4 to be moved rearwardly again. During this sequence, the rounded rear flank of portion 59 limiting groove 58 presses against hammer cocker 56, which has followed the movement of sleeve 17, swivelling hammer cocker 56 clockwise, thereby causing the hammer cocker to drive hammer 54 into the indicated cocker position. If catch link 52 has been released again in the meantime, it engages the recess 53 in sleeve 17, thereby retaining the sleeve in its rearward position again. If, however, catch link 52 is swivelled clockwise, the above described sequence repeats until catch link 52 is released again to interrupt the firing sequence. As the previously described parts are mounted in housing 7 and therefore belong to the recoiling weapon system, the above described sequence is independent of the position of the weapon system relative to the receiver In order to be able to swivel catch link 52 independently of the position of the weapon system in order to fire a sequence of shots, a rail 61 is arranged in receiver 1 parallel to rails 2; said rail 61 is pivotally mounted on a bolt pin 62 extending at right angles to receiver 1 and the rear end of said receiver, while its front, forked end 63 rests on the ends of a bolt 64 which extends through an arm 65 of trigger 42 extending generally parallel to the direction of motion of the weapon system and thus to rail 61 of the trigger mechanism. Pivotally mounted on catch link 52 is an interrupter 66, which is retained by means of a spring in the indicated position in which it is in a contacting relationship with the bottom of catch link 52 by means of the surface of a shoulder 67 in such a manner that it assumes a position which is generally perpendicular to catch link 52 and its end is located a slight distance from rail 61. It can be seen that, by pulling trigger 42 rail 61 can be lifted enough to strike the end of interrupter 66, thereby swivelling catch link 52 clockwise in order to release sleeve 17 of the bolt system. Interrupter 66 is arranged in such a manner that it can be swivelled counterclockwise against the force of a spring tensioning it while lifting the surface of the shoulder away from the bottom of the catch link, so that it is no longer capable of transmitting the position of rail 61 to the catch link and deflecting the catch link.

Trigger 42 is mounted in a separate trigger assembly housing 71, which is attached in receiver 1. Also mounted in the same trigger assembly housing is a sear 72, having a nose 73 located directly opposite the rear edge of trigger 42, and whose angled arm 74, in its position of rest, in which it is in a contacting relationship with a pin 75 under the force of a spring, is located directly opposite the bottom edge of catch link 52, caught in recess 53 of sleeve 17. Also pivotally mounted in trigger 42 is a catch 76, loaded by a coil compression spring 77, whose nose 78 is located opposite nose 73 of sear 72 in the position of rest of trigger 42 in such a manner that, when trigger 42 is pulled, sear 72 is swivelled clockwise by nose 78 on catch 76, thereby taking the catch link out of engagement with sleeve 17 of the bolt system. However during this sequence, nose 78 of catch 76 slides off nose 73 of sear 72, permitting the sear to be returned, by the spring tensioning it, to its initial position, in which the sear is in a contacting relationship with pin 75, even without trigger 42 being released. Thus catch 76 has an interrupting function. Coil compression spring 77 permits the catch to swivel and slide by sear 72, which has returned to its position of rest, when the trigger is released to return to its initial position.

In addition, also pivotally mounted in trigger 42 above catch 76 on bolt 64 serving to lift off rail 61 is a transmission lever 81, which allows the movement of trigger 42 to be transmitted directly to catch link 52 when the weapon system is in its position of rest. Transmission lever 81 is in a contacting relationship with the periphery of a selective fire axle 82, which has a notch 83 in its center, into which transmission lever 81 can fall. When the transmission lever is in a contacting relationship with the periphery of selective fire axle 82, it is retained in a position in which its end comes into engagement with catch link 52 when trigger 42 is pulled. If, on the other hand, selective fire axle 82 is rotated in such a manner that the transmission lever is located in notch 83, transmission lever 81 goes past the end of catch link 52 when trigger 42 is swivelled, and thus does not have any effect.

In addition, the selective fire axle also has indentations 84, whose basic stop surfaces 85 and 86 are located at differing radial distances from the center of the selective fire axle.

Selective fire axle 82 is arranged in such a manner that it is close to the back 87 of trigger 42 and that when swivelled, the back of the trigger engages indentations 84 in the selective fire axle. If the selective fire axle is in a position in which the back 87 of trigger 42 is in a contacting relationship with its periphery, trigger 42 cannot be swivelled and the rifle's safety is engaged. If, on the other hand, selective fire axle 82 is rotated in such a manner that the back of trigger 42 can engage the indentations 84, there are two positions in which the trigger can come into a contacting relationship with stop surfaces 85, which have a large clearance to the center of the selective fire axle, permitting the trigger to only be swivelled a small angle, and two additional positions in which back 87 of trigger 42 comes into a contacting relationship with stop surfaces 86 with a small radical clearance, permitting the trigger to be swivelled a large angle. The small angle of swivel is not sufficient for lifting off rail 61 of the trigger mechanism enough to release the catch link. However this angle of swivel is sufficient to deflect catch link 52 with the aid of the sear and, if necessary, the transmission lever as well, thereby firing a shot. If trigger 42 is swivelled a large angle, rail 61 causes catch link 52 to be lifted above interrupter 66.

And finally, the notch for transmission lever 81 is arranged in such a manner relative to stop surfaces 85 and 86 in the selective fire axle that for every swivel angle of the trigger there is a position in which transmission lever 81 is effective and a second position in which the transmission lever is not effective. In this manner, in addition to the "safe" position, the following four "fire" positions can be set in the rifle illustrated as a practical example:

1. Small trigger swivel angle, transmission lever ineffective: When the trigger is pulled, catch link 52 is deflected by catch 76 and sear 72, causing a shot to be fired. When trigger 42 is pulled all the way, sear 72 is released by catch 76, permitting it to return to its position of rest, even while the trigger is pulled. As a result, catch link 52 is released in time to catch sleeve 17 again after the shot has been fired. The weapon system, which recoils when the shot is fired, is returned forward to its initial position by the first coil compression springs 31, in which position the system remains until the trigger is released and is pulled again for firing an additional shot. Thus, this mode of fire is typical single fire.
2. Small trigger swivel angle, transmission lever 81 effective: When the trigger is pulled, the shot is fired in the above described manner. However, in addition to sear 72, transmission lever 81 is also placed in a position in which it deflects catch link 52 of the weapon system in its position of rest. However, since the weapon system recoils after a shot is fired, the operative connection between transmission lever 81 and catch link 52 is eliminated, causing the catch link to again catch sleeve 17 of the bolt system in its most rearward position. However when the weapon system is moved forward to its initial position by the first coil compression springs, the front end of catch link 52 strikes transmission lever 81, insofar as trigger 42 remains pulled, thus causing a new shot to be fired. This mode of fire is thus automatic fire, whose cadence is a factor of the velocity and path of the movement of the weapon system, mounted movably in the receiver. Since the weapon system has a relatively high mass and, as a result, its movements will be relatively slow, this produces automatic fire with a relatively low rate of fire.
3. Large trigger swivel angle, ineffective transmission lever: With this mode of fire, the first shot is again fired in the above described manner with the aide of sear 72. However in addition, rail 61 is lifted off far enough to hold catch link 52 in a position by means of shoulder 67 of interrupter 66, in which catch link 52 is ineffective. As a result, after the first shot has been fired sleeve 17 is not caught in its most rearward position, but can travel forward again within the movable weapon system to fire an additional shot. This sequence occurs so fast that the next shot is fired before the weapon system has returned to its initial position again. Since there is a new recoil movement of the entire weapon system after the next shot, the weapon system moves further and further backward in the receiver from shot to shot. This is thus fast automatic fire, in which the weapon system moves rearward from shot to shot until either the burst is interrupted or the weapon is stopped by the above described buffer arrangement. To interrupt the burst, the practical example shown in the drawing has a recess 68 in rail 61, in which interrupter 66 on catch link 52 engages after the third shot. This releases catch link 52 from rail 61, permitting it to catch sleeve 17 of the bolt system after the third shot. The burst is thus interrupted, and the weapon system can be returned to its position of rest. During the forward movement, interrupter 66 performs the above described counterclockwise swivel motion which prevents the catch link from being deflected again by rail 61, which is still in its raised position. Thus, recess 68 in rail 61 causes a burst comprising three shots to be fired with this mode of fire. During this burst, the weapon system travels rearwardly, so that, for all practical purposes, no recoil forces whatsoever are transmitted to the receiver. For this reason, with the rifle illustrated as a practical example bursts of three shots can be fired with extremely high accuracy. A burst of this type can be repeated by releasing trigger 42 and pulling it again. If fast automatic fire is desired instead of bursts of this type, there is a slide 69 arranged on rail 61 which can be pushed forward from its position shown in the drawing so that it fills recess 68. In this case, catch link 52 remains deflected until rail 61 has been lifted off by pulling trigger 42, and the automatic fire is not interrupted until trigger 42 is released.
4. Large trigger swivel angle, effective transmission lever: This setting is only useful if recess 68 in rail 61 for interrupting the automatic fire after three shots is effective. In a similar manner to the above described second setting where the transmission lever causes a new shot to be fired upon return of the weapon system to the position of rest, in this case a new burst of three shots is fired upon return of the weapon system to its position of rest, so that this mode of fire consists of automatically repeated bursts of three shots each.

Figure 7:
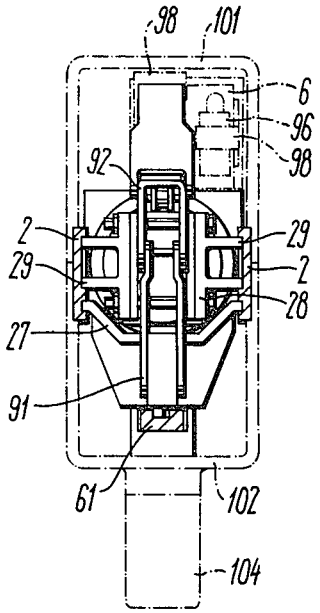
FIG. 7 shows a back view of the arrangement according to FIG. 3 in the direction of arrow VII, however with closed bolt system.
Figure 4:
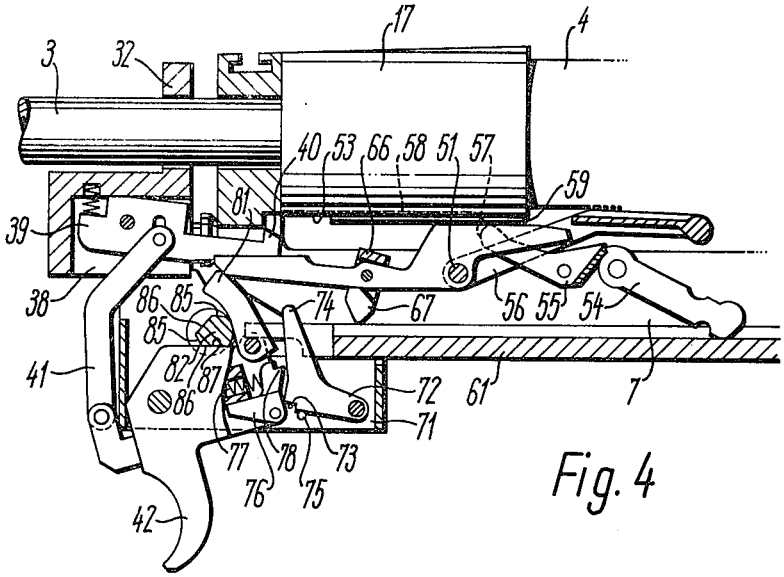
FIG. 4 shows a detail of the trigger system according to FIG. 3 in a different position, with an even larger scale than FIG. 3.
Figure 5:
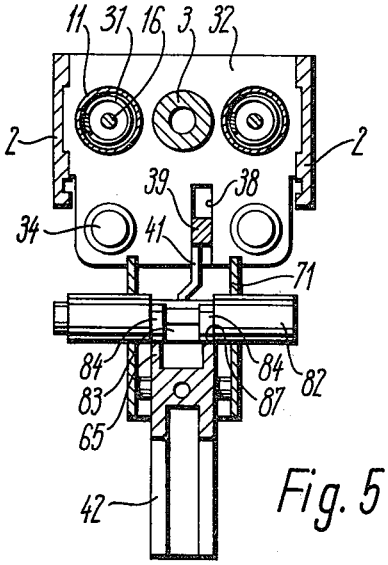
FIG. 5 shows a cross section through the arrangement according to FIG. 3 along line V — V.
Figure 6:
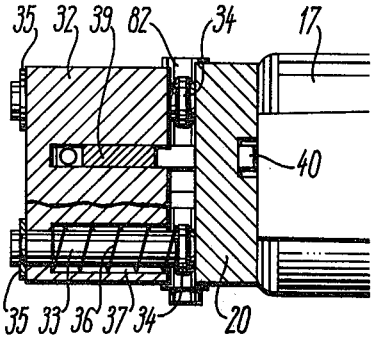
FIG. 6 shows a section through the arrangement according to FIG. 3 along line VI — VI.

In closing, it should also be mentioned that claw arrangement 5 comprises two cranks 91 and 92, which are both mounted at the rear end of bolt system 4 in the area between guide members 28 and are in engagement there by means of a pin-and-shot connection. One end of crank 91 engages a guide cam 93 located in the walls of a housing member 94 located directly adjacent to housing 7, while the free end of the other crank 92 supports a spring gripper 95. By means of guide cams 93, the angular position of cranks 91 and 92 relative to bolt system 4 during movement of the bolt system is controlled in such a manner that gripper 95 on crank 92 grasps the first cartridge 96 in magazine 6 and inserts it into the space between a block located in the bolt system and the rear end of the barrel 3 through an aperture 97 in the tubular front section of bolt system 4 during the rearward movement of the bolt system. Crank 92 is swivelled outward again during the forward motion of bolt system 4 as soon as the inserted cartridge has been located by the barrel and/or the block in the bolt system. Cartridges 96 are arranged upright in the magazine, i.e. perpendicular to the barrel axis, and are normally retained by levers 98 articulated to the magazine, which are deflected by gripper 95 when the gripper grasps a new cartridge. As can be seen from FIG. 7, the magazine is of a two-row design and can be swivelled about the bearing on block 13 of the weapon system in order to bring cartridges from either the one or the other row into the area of operation of the gripper.

Receiver 1 comprises two generally rectangular plastic members 101 and 102, of which the top rear half of upper member 101 has a cover 103 which permits magazine 6 to be exchanged. Bottom plastic member 102 has a grip 104 and a recess in which trigger assembly housing 71, containing trigger 42, is inserted. Trigger assembly housing 71 is retained by selective fire axle 82, which extends through the walls of both the lower plastic member and trigger assembly housing 71. The separation joint between the two plastic members 101 and 102 extends in the area of rails 2, which serve to locate and guide the weapon system and to which the two plastic members are attached. Rails 2 are connected one with the other to form a rigid frame by a bolt 105 and a connecting member 106 at their ends as well as receiver flange 32 in the middle of rails 2. And finally, located on the outside at the right of receiver 1 is a cocking mechanism comprising two levers 107 and 108, of which lever 107, having a handle, is mounted in a block 109 arranged on the outside of recever 1, while the other is articulated to the area of the center of the first lever 107 and spring loaded in such a manner that when lever 107 is swivelled outward, its end 110 penetrates into the interior of the receiver in a slot 111 and engages a recess 112 in sleeve 17 of the bolt system. If lever 107, with the handle, is swivelled out further, lever 108, and with it sleeve 17, is moved rearwardly until sleeve 17 is caught in the cocked position by catch link 52. In the position of rest, in which both levers 107 and 108 rest flat against the outside of the receiver, lever 107 engages a recess in block 109 by means of a springloaded pin 113, thereby dependably retaining the cocking mechanism in this position of rest.

Obviously, many modifications and variations of the present invention are possible in the light of the above teachings. It should therefore be understood that within the scope of the appended claims, the invention may be practical otherwise than as specifically described.

Having thus fully disclosed by invention, what I claim is:

1. In an automatic shoulder arm having a stock; a receiver formed in the stock; a barrel longitudinally movably supported in the stock for executing a sliding motion between forward and rearward limit positions; a bolt assembly mounted on the barrel and being displaceable with respect to the barrel in the longitudinal direction thereof; gas operated action for moving the bolt assembly rearwardly with respect to the barrel upon firing a shot; a trigger mechanism dispoded in the receiver; a cartridge feeding device for introducing a new cartridge into the barrel upon firing a shot; spring means for urging said barrel and said bolt assembly in a direction opposing the force exerted by the gas operated action and recoil effect; the improvement comprising means coupled to said barrel, said bolt assembly, said gas operated action, said trigger mechanism and said cartridge feeding device for firing a plurality of successive shots while said barrel is in successive intermediate positions between said limit positions during its rearward travel.

2. The shoulder arm set forth in claim 1, wherein said trigger mechanism includes a first portion stationarily supported in said stock and a second portion coupled with and displaceable with respect to said first portion in a direction parallel to the travelling path of said barrel; said means comprising a device for combining said barrel, said bolt assembly, said gas operated action, said second portion of said trigger mechanism and said cartridge feeding device into a structural unit constituting an operational weapon system; said unit being displaceably mounted in said receiver for rearward movement as a whole by recoil effect after a shot is fired; said springs means including a first recoil spring means for urging said unit forwardly against the force of the recoil effect and a second recoil spring means forming part of said unit and urging said bolt assembly forwardly and towards said barrel against the force exerted on said bolt assembly by said gas operated action.

3. The shoulder arm set forth in claim 2, in which said gas operated comprises two gas cylinders arranged parallel to the barrel, the front ends of said gas cylinders being connected with the barrel by means of a block containing radial channels through which the bore of the barrel communicates with their interiors and the rear ends thereof being connected with the barrel by means of a cross member, in which a trigger housing for mounting components of the trigger mechanism is arranged directly behind said cross member and travels with it, and in which said block and said cross member have lateral shoulders and the rear end of said housing gas a slide having lateral arms which engage grooves in rails mounted in the receiver and serving to guide and locate the weapon system.

4. The shoulder arm set forth in claim 3, in which the front end of said bolt system has a tubular section with which the bolt system is located on the rear end of the barrel, extending from the cross member, and the rear end of said bolt system engages the rails with lateral webs.

5. The shoulder arm set forth in claim 3, in which said first recoil spring means include first coil springs arranged on said gas cylinders, said first coil springs acting as counterrecoil springs and being in a supporting relationship with the block connecting the gas cylinders and the barrel, on the one hand, and with an abutment attached in the receiver, on the other.

6. The shoulder arm set forth in claim 5, further comprising a buffer arrangement between the weapon system and the receiver for stopping the weapon system in a rear end position as it travels rearwardly during a plurality of successive shots, said buffer arrangement comprising second coil compression springs forming part of said first recoil spring means and arranged on the gas cylinders, said second coil compression springs surrounding the first coil compression springs concentrically and being coiled in the opposite sense, having a higher spring rate than the first coil compression springs, and having their length selected in such a manner that, at the end of the intended return travel path, if necessary with the first coil compression springs being interposed, they are in a supporting relationship with tube sections on the block surrounding at least a portion of their length and with the abutment.

7. The shoulder arm set forth in claim 5, in which bolts are slidably mounted in an abutment attached in the receiver, whereby in the position of rest of the weapon system the heads of said bolts are in a contacting relationship, under the force of coil compression springs surrounding them, with the front side of the cross member connecting the gas cylinders and the barrel.

8. The shoulder arm set forth in claim 5, in which said abutment is a receiver flange connecting the rails in the vicinity of their centers, said receiver flange having through holes for the barrel and the gas cylinders and being directly adjacent, in the position of rest of the weapon system, to the cross member connecting the gas cylinders and the barrel.

9. The shoulder arm set forth in claim 8, further comprising a catch mounted in said receiver flange, said catch being connected with a trigger mounted in the receiver by means of a draw bar, said catch lockngly engaging behind a shoulder of said cross member or retaining said weapon system in its position of rest; aid catch releasing said weapon system when said rigger is pulled; said catch, said trigger and said draw ar forming parts of said trigger mechanism.

10. The shoulder arm set forth in claim 2, in which, in s position of rest, the weapon system is in a contacting elationship with a counterrecoil buffer attached in the eceiver, said counterrecoil buffer permitting a limited orward movement of the weapon system.

11. The shoulder arm set forth in claim 2, in which e weapon system is retained in its position of rest by catch mounted in the receiver, said catch being conected with a trigger, mounted in the receiver, by eans of a draw bar and releasing the weapon system hen said trigger is pulled, said catch, said trigger and aid draw bar forming parts of said trigger mechanism.

12. The shoulder arm set forth in claim 2, in which, etween the weapon system and the receiver, there is a uffer arrangement which stops the weapon system, hich travels rearwardly during a plurality of succesve shots, in a rear end position.

13. The shoulder arm set forth in claim 2, in which aid cartridge feeding device comprises a magazine rranged parallel to the barrel and a claw arrangement rticulated to the bolt system, said claw arrangement emoving the cartridges, standing generally perpendiclar to the barrel, from the magazine and inserting em in the space between the open bolt system and the ear end of the barrel.

14. The shoulder arm set forth in claim 2, in which aid trigger mechanism comprises a trigger and a rail, ounted in the receiver, said rail extending parallel to e path of the weapon system, and having a rear end ivotally mounted about a pin in the receiver, said pin eing arranged at right angles to the path of the weapon stem; said rail having a front end in engagement with e trigger in such a manner that, when the trigger is ulled, the distance between the rail and the weapon stem is reduced, and in which said second portion of e trigger mechanism comprises members controlled y the distance between the rail and the weapon sysm, said members causing shots to be fired if a given istance is not maintained.

15. The shoulder arm set forth in claim 14, in which id rail has a recess through which the distance beeen the rail and the weapon system is increased by ch an amount at the location of the recess that the embers controlled by the distance between the rail d the weapon system cause the sequence of shots to interrupted when they respond to the recess after a edetermined number of shots as a result of the rearard travel of the weapon system.

16. The shoulder arm set forth in claim 15, further mprising a slide mounted on said rail and being disaceable with respect thereto; said slide having a posion on said rail in which it fills said recess.

17. The shoulder arm set forth in claim 14, in which lever is in an operative connection with the trigger, id lever being able to be brought into engagement, by ivelling the trigger, with the members, causing shots be fired, of the weapon system located in its position rest in order to fire a shot before the rail has been flected sufficiently to fire shots, and in which there is an adjustable stop for limiting the travel of the trigger when pulled.

18. The shouldr arm set forth in claim 17, in which a transmission lever is pivotally mounted on the trigger and there is an adjustable guide for said transmission level, said guide either guiding the transmission lever past the elements causing shots to be fired at a distance therefrom or bringing it into engagement with such members when the trigger is pulled.

19. The shoulder arm set forth in claim 17, in which a sear is mounted in the receiver, said sear, in its position of rest, is in a contacting relationship with one of the members of the weapon system causing shots to be fired in the position of rest of the weapon, said sear can be swivelled in such a manner by means of a catch attached to the trigger when the trigger is pulled that it causes a shot to be fired, while the catch slides off the sear, thus releasing the sear and permitting it to return to its position of rest.

20. The shoulder arm set forth in claim 17, in which the stop for the trigger is formed by surfaces of a selective fire axle arranged parallel to the axis of rotation of the trigger.

21. The shoulder arm set forth in claim 20, in which the trigger is mounted in a trigger assembly housing attached in the receiver and the selective fire axle extends through the receiver and the trigger assembly housing as a linch pin.

22. The shoulder arm set forth in claim 20, in which said selective fire axle has a stop surface which blocks the trigger for safety.

23. The shoulder arm set forth in claim 14, said shoulder arm being a weapon firing from a closed bolt position and the members causing shots to be fired comprise a catch link for a portion of the bolt system and an interrupter, pivotally mounted on said catch link and sensing that side of the rail facing the weapon system.

24. The shoulder arm set forth in claim 23, in which the lever in an operative connection with the trigger can be brought into engagement with the said catch link.

25. In an automatic shoulder arm having a stock; a receiver formed in the stock; a barrel longitudinally movably supported in the stock for executing a sliding motion between forward and rearward limit positions; a bolt assembly mounted on the barrel and being displaceable with respect to the barrel in the longitudinal direction thereof; gas operated action for moving the bolt assembly rearwardly with respect to the barrel upon firing a shot; a trigger mechanism disposed in the receiver; a cartridge feeding device for introducing a new cartridge into the barrel upon firing a shot; spring means for urging said barrel and said bolt assembly in a direction opposing the force exerted by the gas operated action and recoil effect; the improvement comprising means coupled to said barrel, said bolt assembly, said gas operated action, said trigger mechanism and said carriage feeding device for firing a plurality of successive shots while said barrel is in intermediate positions between said limit positions during its undirectionally rearward travel.

* * * * *